United States Patent [19]

Pitcher et al.

[11] Patent Number: 4,922,991

[45] Date of Patent: May 8, 1990

[54] COMPOSITE CORE ASSEMBLY FOR METAL CASTING

[75] Inventors: Michael A. Pitcher, Powell; Albert L. Haugse, Dublin; Richard L. Pelfrey; Gregory P. Sturtz, both of Worthington, all of Ohio

[73] Assignee: Ashland Oil, Inc., Ashland, Ky.

[21] Appl. No.: 903,192

[22] Filed: Sep. 3, 1986

[51] Int. Cl.[5] ..... B22C 9/04

[52] U.S. Cl. ..... 164/36; 164/132; 164/522

[58] Field of Search ..... 164/32, 34–36, 164/132, 137, 232, 246, 249, 522

[56] References Cited

U.S. PATENT DOCUMENTS

| | | | |
|---|---|---|---|
| Re. 31,488 | 1/1984 | Trumbauer | 164/32 |
| 3,108,341 | 10/1963 | Amala | 164/32 |
| 4,093,018 | 6/1978 | Trumbauer | 164/32 |
| 4,384,607 | 5/1983 | Wood et al. | 164/35 |
| 4,462,453 | 7/1984 | Trumbauer | 164/32 |

FOREIGN PATENT DOCUMENTS

| | | | |
|---|---|---|---|
| 2569225 | 2/1986 | France | 164/34 |
| 55-16720 | 2/1980 | Japan | 164/522 |
| 55-36031 | 3/1980 | Japan | 164/522 |
| 57-184549 | 11/1982 | Japan | 164/522 |

*Primary Examiner*—Richard K. Seidel
*Attorney, Agent, or Firm*—Mueller and Smith

[57] ABSTRACT

Disclosed is a method for making metal castings wherein a composite core assembly is utilized. The composite core assembly comprises at least one casting core and one temporary core which are in intimate contact wherein the temporary core is removed prior to casting. The improvement of the present invention comprises forming the temporary core comprising an aggregate and binder of materials such that the temporary core is sufficiently soluble in aqueous solvent for its removal prior to metal casting. The casting core is not removed by the aqueous solvent.

6 Claims, No Drawings

COMPOSITE CORE ASSEMBLY FOR METAL CASTING

BACKGROUND OF THE INVENTION

The present invention relates to the foundry art and more particularly to casting utilizing a unique composite core assembly.

Castings that exhibit numerous cavities and passageways often are difficult to cast due to the complex core arrangement necessitated by the geometry of the casting. For example, engine cylinder heads require water jacket passages and gas ports which has necessitated the handling and assembling of numerous cores. Often, some assemblies were pasted or glued together in order to complete the core assembly in the core box. Such gluing technique was found to be unsatisfactory due to the tendency of the casting to contain unwanted fins and like defective areas.

Another problem associated with such castings was the need for providing wall sections of varying thickness within the interior of the casting. Thin wall sections can be difficult to achieve as those knowledgeable in the foundry art will appreciate.

An apparent solution to the foregoing problems is proposed in U.S. Pat. No. 4,462,453 and U.S. Reissue No. 31,488. The '488 reissue patent proposes a composite core assembly wherein conventional casting cores are placed in intimate contact with temporary cores molded from a destructable cellular plastic material typified by polystyrene and various methacrylic acid-based polymers. The plastic cores were molded to the desired shape of the metal casting itself while the conventional casting cores were intended to occupy the voids or empty cavities within the casting. After the composite core assembly was set in the casting box and the cope and drag sections united, molten metal would be poured into the core box resulting in the destruction of the plastic core by the hot metal. Resulting vaporous material from the plastic core would be vented by the conventional venting system provided in the core box.

One of the problems plaguing such a proposal was the inability for complete removal of gaseous by-products resulting from the plastic core. The '453 patent proposed to solve such problems by dissolving the polystyrene or other plastic material forming the temporary core utilizing aromatic or halogenated hydrocarbon solvents, including benzene, toluene, 1-1-1-trichloroethane, and the like. After the solvation of the plastic core, the casting operation could proceed as normal.

Deficiencies in the solvent dissolving process include the use of solvents which are expensive, require exposure limits, and cause dissolved plastic to penetrate into the casting core. Also, the dimensions of the casting core can be distorted and the casting core eroded when the core is blown around the plastic material. Further, this process is labor intensive. Thus, the need for improvements in such composite core assembly casting technology is present.

BROAD STATEMENT OF THE INVENTION

The present invention is addressed to a method for making metal castings wherein a composite core assembly comprising at least one casting core and one temporary core are in intimate contact and wherein the temporary core is removed prior to the casting operation. The improvement in process of the present invention comprises forming the temporary core comprising an aggregate and a binder of material such that the temporary core is sufficiently soluble in aqueous solvent for its removal prior to the metal casting operation proceeding. The casting core is not removed by the aqueous solvent dissolution step of the process. The aggregate can be soluble in aqueous solvent, partially soluble in aqueous solvent, or insoluble in aqueous solvent. Further, the aggregate can be a mixture of aggregate materials some of which is soluble in aqueous solvent. Correspondingly, the binder can be soluble in aqueous solvent, insoluble in aqueous solvent, or a blend thereof. Of course, at least the aggregate, the binder, or both are material such that treatment with aqueous solvent will dissolve the temporary core for its removal.

Advantages of the present invention include the use of solvents that do not present a health hazard to workers and are much less expensive than organic solvents used in the past. Another advantage is the ability to utilize aqueous solvents which do not jeopardize the integrity of the core mold assembly. Another advantage is the ability to form temporary cores utilizing aggregates which are common to foundries. Another advantage is that the aggregate used to form the core may be subjected to reclaiming operations for reuse. A further advantage is that the casting core does not necessarily have to be irregular in shape which limitation is placed on prior temporary cores. These and other advantages wil be readily apparent to those skilled in the art based upon the disclosure contained herein.

DETAILED DESCRIPTION OF THE INVENTION

Requirements which the temporary core should possess are diverse so that a unique system is required for achieving these requirements. Such requirements include that the temporary core mate or engage and conform to the surface of the casting core. Further, the temporary core should be hard, durable, and not easily scratched so that it can be handled under conventional foundry conditions. Also, since the core is temporary and will be removed prior to the casting operation, the temporary core should be easily constructed and inexpensive. Further, the temporary core should not scratch or mar the surface of the casting core so that the final metal casting will retain the surface quality desired. Also, it would be advantageous for the temporary core to be made of materials, some of which are normally encountered in foundry operations. Another important requirement for the temporary core is that it be able to be formed in any shape desired regardless of whether the casting core with which it mates has a smooth surface, an irregular surface, or the like. A limitation on use of conventional cellular plastic material cores is that they must be used only where the casting core has an irregular surface. Such limitation is obviated by the present invention. Finally, it would be desirable, though not necessary, that the material utilized in fashioning a temporary core be reclaimable for contributing to the economics of the process.

The temporary cores and solvent system of the present invention can be designed to meet the foregoing requirements rather readily under most casting conditions. This achievement is accomplished by basing the temporary cores on the use of an aggregate and binder system much like conventional casting cores employ, but where the aggregate, the binder, or both can be adequately solvated by aqueous solvent for removal of the temporary core prior to the casting operation. It will be appreciated that foundry personnel are familiar with the use of aggregate/binder systems for manufacturing casting cores, so that this experience will contribute to their ability to implement the temporary core invention with little difficulty. Further, it will be appreciated that the use of a water-based solvent system presents less environmental and safety risk at the foundry. Further, the aqueous solvent should not present an unacceptable cost in the process.

For purposes of the present invention, a "casting core" is a conventional, e.g. aggregate, core utilized in metal casting operations wherein molten metal is cast into a desired shape or configuration based upon the casting core. Conversely, a "temporary core" for present purposes is a core which is utilized in the manufacture of the casting core for providing appropriate spacing and for cavities contained within the casting core. The temporary core is designed to be removed prior to (or contemporaneously with, per the prior art) the metal casting operation and does not control directly the ultimate configuration of the metal casting, which is controlled by the shape of the casting core.

The aggregate portion of the temporary core can possess varying degrees of solubility in aqueous solvent ranging from total insolubility to being quite soluble in aqueous solvent. Soluble aggregate can be represented by sucrose, starch, or like particles which can be adequately bound together by a binder system to make temporary cores of sufficient integrity for use, though such soluble aggregate system is not presently preferred. For expediency and durability, it is preferred to utilize normal foundry aggregate which aggregate is used in making the casting cores. Such aggregate typically will be a silica sand optionally containing additives such as iron oxide, ground flax fibers, or the like. Such additives, though, ordinarily will not be required since the core is temporary, i.e. not intended to be utilized during the metal casting operation. The use of silica sand or other foundry aggregate gives the foundry personnel familiarity with the materials to be utilized in the making of the temporary core as well as take advantage of material normally found in the foundry. Further, reclamation of the silica sand often may be practiced in those foundries which practice sand reclamation from the casting cores. It will be appreciated, though, that a variety of additional aggregate materials may be utilized in forming the temporary cores, for example, a blend of silica sand and sucrose (or starch) particles.

The binder for the temporary core also can exhibit varying degrees of solubility in aqueous solvent. The degree of water solubility of the binder necessarily must be adjusted based upon the degree of solubility of the aggregate utilized in forming the temporary core. When utilizing water-soluble aggregate, such as sucrose particles, it may be desirable to utilize a binder which is relatively insoluble in water. Binders relatively insoluble in aqueous solvent can be those binders typically encountered in foundry practice when making casting cores. Conventional casting core binders often are based upon phenolic or modified phenolic resins including, for example, polyether phenol resins (U.S. Pat. No. 3,676,392), benzylic ether modified phenolic resins (U.S. Pat. No. 3,409,579), silane-modified phenolic resins (U.S. Pat. No. 3,429,848), and like phenolic and modified phenolic resins. Typically, the phenolic resin is blended with an isocyanate or modified isocyanate for making a urethane binder. The phenolic/isocyanate reaction typically is catalyzed by an amine which can be vaporous or liquid as is necessary, desirable, or convenient. Such phenolic binder systems can be utilized to advantage in forming the temporary cores of the present invention, provided that the aggregate possesses sufficient solubility in water for the temporary core to be removed by the aqueous solvent. Additional conventional binders include alkyd urethanes, polyurethanes, and the like.

Binders which exhibit sufficient solubility in water for removal of the temporary core include, for example, simple sucrose/water binder systems or like sacarifarous-based binders, starch/water binder systems, aluminum phosphate binder systems (U.S. Pat. Nos. 3,923,525, 3,930,872, 3,968,828, and 4,070,195), sodium silicate binders and like binder systems. Sufficient core integrity even may be achieved by freezing a sand/water mixture with $CO_2$, $N_2$, or the like. Such water-soluble binder systems are preferred for use in making the temporary cores of the present invention utilizing conventional silica sand aggregate, as the examples will demonstrate. The proportion of binder utilized in making the temporary core is an amount effective for making a temporary core of suitable hardness, durability, and like properties. Ordinarily, the proportion of binder will range from about 0.5 to about 5% based on the weight of the aggregate in the core.

The aqueous solvent utilized for dissolution of the temporary core preferably will be water, though organic cosolvents (e.g. lower alkanols or the like) can be used if necessary, desirable, or convenient. Further, it should be recognized that the aqueous solvent can be heated for assisting in removal of the temporary core and sprayed under pressure if required or desired. An advantage of utilizing a water-soluble binder and insoluble silica sand aggregate is that the aggregate can be separated from the water following removal of the temporary core relatively easily for disposal or reclamation of the aggregate and/or aqueous solvent. Other additives may be included in the aqueous solvent to promote removal of the temporary core including, for example, various salts, very fine powder for assisting in material removal, aqueous acids, or aqueous bases, and the like.

The following examples show how the present invention has been practiced, but should not be construed as limiting. In this application, all percentages and proportions are by weight unless otherwise expressly indicated. Also, all citations referenced herein are incorporated expressly herein by reference.

EXAMPLE 1

A soluble core was made from insoluble aggregate and partially water-soluble binder as follows:

Aggregate: Wedron 510 silica sand (>2GFN or Grain Fineness Number, Wedron Silica Co.)

Binder: Chem-Rez 630 resin (A phenolic, no-bake foundry binder with the following specifications: viscosity of 250–300 cps at 70° F., 0% nitrogen, 0.3% free formaldehyde, 0.6% free phenol, 10.2 lbs/gal density, flash point of 199° F.; Ashland Chemical Company, Dublin, Ohio, 92% by weight of binder; and potassium hydrogen phthalate (8% by weight of binder).

The aggregate mix was formed from the silica sand and 1% by weight of the binder.

Tensile briquettes were formed (hot box tooling at 450° F., dwell time 60 sec.) from the aggregate and broken immediately to provide a strength of 33 psi. The briquettes tested at 83 psi tensile strength upon cooling. The briquettes exhibited a water-insoluble skin (estimated at about ¼ inch) with the interior incured balance of the briquete being very soluble in water.

EXAMPLE 2

A soluble core was made from insobule aggregate and a water-soluble binder as follows:
Aggregate: Wedron 510 silica sand
Binder: 60% sucrose, 40% water
Mix: 2% binder based on weight of aggregate.

Tensile briquettes were formed and baked for 12 minutes at 250° F. The briquettes exhibited cold tensile strengths of greater than 100 psi, yet were totally soluble in water. Briquettes also can be formed by microwaving, e.g. for about 2–3 minutes, followed by cooling to room temperature.

EXAMPLE 3

A soluble core was made from water-soluble aggregate and an insoluble binder as follows:
Aggregate: Sucrose particles
Binder:
Phenolic resin (9.2 lbs/gal, viscosity 1.8 stokes, 55.3% solids typical, 0.2% free formaldehyde typical)
Polymeric MDI (9.6 lbs/gal, viscosity 10.22 stokes, 24.6% NCO calculated)
Mix: 0.8% binder based on weight of aggregate The binder (55/45 weight ratio phenol resin to isocyanate) in the mix was cured by application of a vaporous amine (dimethylethyl amine) to make briquettes which exhibited immediate strengths of 27 psi. The briquettes were soluble in water.

EXAMPLE 4

Cores were blown around the briquettes formed in Examples 1–3 utilizing a standard cold-box foundry process as follows:
Aggregate: Wedron 510 silica sand
Binder: Phenolic resin/isocyanate system of Example 3 (1.5% by weight of aggregate)
Blow: 0.5 sec. at 40 psi
Gas: Dimethylethyl amine for 1 second at 40 psi
Purge: Air for 4 seconds at 40 psi Thereafter the tensile briquettes were dissolved and removed with water and the blown cores heated at 350° F. for ten minutes to dryness. The dried cores were found to have complete integrity and a smooth surface finish.

EXAMPLE 5

A soluble core was made from insoluble aggregate and a water-soluble binder as follows:
Aggregate: Wedron 510 Silica sand
Binder: Inoset R-9 binder (aluminum phosphate binder with the following specifications: stokes viscosity of 1.55–2.05 at 70° F., 13.6 lb/gal. density, flash point of 230° F., Ashland Chemical Co., Dublin, Ohio)
Mix: 2% binder based on weight of aggregate Tensile briquettes formed (cold-box tooling) from the mix were broken immediately to yield a strength of 17 psi. The briquettes tested at 38 psi strength 5 minutes after formation. The briquettes were found to be soluble in water.

Alternatively, conventional $CO_2$-cured silicate binders (e.g. about 3% sodium silicate by weight of aggregate) could be used to make temporary cores and would be expected to yield 20–30 psi immediate strengths and a 40–100 psi strength range in 24 hours. All $CO_2$-cured sodium silicate binders are water-soluble with the degree of solubility dependent upon, e.g. the composition of the binder.

We claim:

1. In a method for making metal castings wherein a composite core assembly comprising at least one casting core and one temporary core are in intimate contact and wherein said temporary core is removed prior to casting, the improvement which comprises:

forming said temporary core comprising an aggregate and a binder selected from the group consisting of a silica sand aggregate and a sucrose or starch and water binder, or an aggregate soluble in aqueous solvent and a phenolic resin binder; said temporary core being sufficiently soluble in aqueous solvent for its removal prior to metal casting, said casting core not being removed by said aqueous solvent.

2. The method of claim 1 wherein said aggregate comprises silica sand and said binder comprises sucrose or starch and water.

3. The method of claim 1 wherein said aggregate is soluble in said aqueous solvent and said binder comprises a phenolic resin.

4. In a method for making metal casting which comprises:

(a) fabricating a casting core;
(b) forming a temporary core which is in intimate contact with at least a portion of said casting core, said temporary core comprising an aggregate and a binder selected from the group consisting of a silica sand aggregate and a sucrose or starch and water binder, or an aggregate soluble in aqueous solvent and a phenolic resin binder; said temporary core being sufficiently soluble in aqueous solvent for its removal;
(c) inserting said compositing core and temporary core as an assembly into a casting mold; and
(d) dissolving said temporary core with aqueous solvent.

5. The method of claim 4 wherein said aggregate comprises a silica sand and said binder comprises sucrose or starch and water.

6. The method of claim 4 wherein said aggregate is soluble in said aqueous solvent and said binder comprises a phenolic resin.

* * * * *